US011372377B2

(12) United States Patent
Akiyama

(10) Patent No.: US 11,372,377 B2
(45) Date of Patent: Jun. 28, 2022

(54) ELECTRONIC TIMEPIECE WITH LEAP SECOND INFORMATION ACQUISITION

(71) Applicant: Seiko Epson Corporation, Tokyo (JP)

(72) Inventor: Toshikazu Akiyama, Matsumoto (JP)

(73) Assignee: Seiko Epson Corporation

( * ) Notice: Subject to any disclaimer, the term of this patent is extended or adjusted under 35 U.S.C. 154(b) by 622 days.

(21) Appl. No.: 16/357,466

(22) Filed: Mar. 19, 2019

(65) Prior Publication Data

US 2019/0294123 A1 Sep. 26, 2019

(30) Foreign Application Priority Data

Mar. 20, 2018 (JP) ..... JP2018-052256

(51) Int. Cl.
*G04R 20/04* (2013.01)

(52) U.S. Cl.
CPC ..... *G04R 20/04* (2013.01)

(58) Field of Classification Search
None
See application file for complete search history.

(56) References Cited

U.S. PATENT DOCUMENTS 9,448,539 B2 * 9/2016 Akiyama ..... G04R 20/00
10,001,757 B2 * 6/2018 Akiyama ..... G04R 20/04
2012/0201101 A1 8/2012 Akiyama et al.
2012/0243383 A1 * 9/2012 Honda ..... G04R 20/04 368/47
2014/0293756 A1 10/2014 Akiyama
2016/0026157 A1 * 1/2016 Baba ..... G01S 19/33 342/357.73
2016/0259304 A1 * 9/2016 Fujisawa ..... G04C 10/04

FOREIGN PATENT DOCUMENTS

JP 2012-167931 A 9/2012
JP 2014-190936 A 10/2014
JP 2014-196952 A 10/2014
JP 2015-055478 A 3/2015
JP 2018-036106 A 3/2018

* cited by examiner

*Primary Examiner* — Amy Cohen Johnson
*Assistant Examiner* — Kevin Andrew Johnston
(74) *Attorney, Agent, or Firm* — Harness, Dickey & Pierce, P.L.C.

(57) ABSTRACT

An electronic timepiece includes a receiver that executes reception process to capture a position information satellite transmitting leap second information and receive a satellite signal transmitted from the captured position information satellite and a controller that acquires the leap second information on the basis of the satellite signal received by the receiver, in which the controller determines whether or not to stop the reception processing on the basis of a type of the satellite signal receivable from the position information satellite captured by the receiver.

12 Claims, 11 Drawing Sheets

FIG. 5

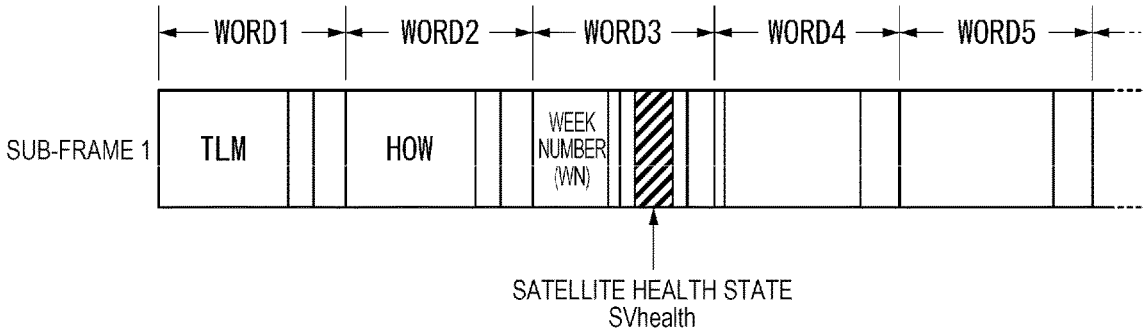

FIG. 6

| MESSAGE | SUB-FRAME IN WHICH INFORMATION IS STORED | MAXIMUM BROADCAST INTERVAL (SECONDS) |
|---|---|---|
| SV CLOCK | SUB-FRAME 1 | 30 |
| EPHEMERIS | SUB-FRAMES 2 AND 3 | 30 |
| GROUP DELAY CORRECTION PARAMETER | SUB-FRAMNE 1 | 30 |
| QZS ALMANAC | SUB-FRAMES 4 AND 5 | 600 |
| ALAMANAC REFERENCE WEEK NUMBER OF QZS, HERTZ SIGNAL OF REFERENCE TIME AND QZS (PRN 193~197) | SUB-FRAMES 4 AND 5 | 60 |
| IONOSPHERE PARAMETER (WIDE AREA) UTC PARAMETER | SUB-FRAMES 4 AND 5 | 60 |
| IONOSPHERE PARAMETER (AREA CLOSE TO JAPAN) UTC PARAMETER | SUB-FRAMES 4 AND 5 | 60 |

ELECTRONIC TIMEPIECE WITH LEAP SECOND INFORMATION ACQUISITION

BACKGROUND

1. Technical Field

The present invention relates to an electronic timepiece.

2. Related Art

When a satellite signal transmitted from a GPS (Global Positioning System) satellite is received and time is corrected, it is necessary to acquire leap second information and reflect the leap second information in the time correction (for example, refer to JP-A-2015-55478).

An electronic timepiece disclosed in JP-A-2015-55478 acquires the leap second information from the GPS satellite. At this time, if 60 or more seconds elapse since a start of the leap second information reception without acquiring the leap second information, it is determined that the reception has timed out, and the leap second information reception is terminated. In this way, reception processing acquired can be prevented from continuing in a state where the leap second information cannot be acquired, and power consumption can be suppressed.

In JP-A-2015-55478, reception processing is executed in time with an interval of 12.5 minutes at which the GPS satellite transmits the leap second information. Then, when the reception processing times out, the reception processing is terminated.

Here, since a quasi-zenith satellite transmits the leap second information at an interval of one minute, sometimes the leap second information transmitted from a quasi-zenith satellite is received while the reception processing of the leap second information transmitted from the GPS satellite is being executed. In this case, if a reception processing times out, the reception processing ends even while the leap second information transmitted from the quasi-zenith satellite is being received. Therefore, there is a problem that the reception processing which would have been successful had the reception processing continued without a timeout fails and that a reception success rate declines.

SUMMARY

An advantage of some aspects of the invention is to provide an electronic timepiece that can improve the reception success rate of the leap second information and suppress power consumption.

An electronic timepiece according to an aspect of the invention includes a receiver that executes reception process to capture a position information satellite transmitting the leap second information and receive a satellite signal transmitted from the captured position information satellite and a controller that acquires the leap second information on the basis of satellite signal received by the receiver. The controller determines whether or not to stop the reception process on the basis of the type of satellite signal receivable from the position information satellite captured by the receiver.

According to the aspect of the invention, the receiver executes reception process to capture the position information satellite that transmits the leap second information and receive the satellite signal transmitted from the captured position information satellite. Then, the controller acquires the leap second information on the basis of the satellite signal received by the receiver. At this time, the controller determines whether or not to stop the reception process on the basis of the type of satellite signal receivable from the position information satellite captured by the receiver.

Here, examples of the position information satellite that transmits the leap second information include a position information satellite used in the global navigation satellite system (GNSS: Global Navigation Satellite System) such as GPS, and a position information satellite used in the regional navigation satellite system satellite (RNSS: Regional Navigation Satellite System) such as the quasi-zenith satellite system (QZSS: Quasi-zenith Satellite System). In this case, it is assumed that the satellite signal of the leap second information transmitted at intervals of 12.5 minutes is received from a GPS satellite and the satellite signal of the leap second information transmitted every minute is received from the quasi-zenith satellite.

Therefore, since it is necessary to continue the reception process for a maximum of 12.5 minutes if the receivable satellite signal is transmitted from the GPS satellite and the power consumption increases, the controller determines to stop the reception process.

On the other hand, if the receivable satellite signal is transmitted from the quasi-zenith satellite, for example, the possibility that the leap second information can be acquired every one or two minutes is high, so that the controller may determine not to stop the reception process. In this way, the reception success rate can be increased while the power consumption can be suppressed.

In the electronic timepiece according to the aspect of the invention, it is preferable that the receiver executes the reception process to capture a first position information satellite that transmits the leap second information at a first intervals, capture a second position information satellite that transmits the leap second information at a second intervals which are shorter than the first intervals, and receive the first satellite signal transmitted from the captured first position information satellite and the second satellite signal transmitted from the captured second position information satellite, and that, when the leap second information cannot be acquired during a predetermined time period since the start of the reception process, the controller determines to continue the reception process to receive the second satellite signal if the receiver is in a state of capturing the second position information satellite, and determines to stop the reception process if the receiver is in a state of not capturing the second position information satellite.

Here, the first position information satellite that transmits the leap second information at the first intervals includes the GPS satellite, and the second position information satellite that transmits the leap second information at the second intervals which are shorter than the first intervals includes the quasi-zenith satellite, for example.

According to the aspect of the invention with this configuration, when the leap second information cannot be acquired during the predetermined time period since the start of the reception process, that is, when the reception process times out, the controller determines to continue the reception process if the receiver is in a state of capturing the second position information satellite. In this case, since the receiver is in a state of capturing the position information satellite that transmits the leap second information at the short intervals like the quasi-zenith satellite, it can be expected that the leap second information can be acquired during a short time period if the reception process to receive the second satellite signal transmitted from the second position information satellite continues. Further, if the reception process stops and then the reception process is resumed, the power consumption will increase since it is necessary to execute from the capturing of the position information satellite again. Therefore, by determining not to stop the reception process, the controller can increase the reception success rate while suppressing the power consumption.

On the other hand, when the reception process times out, the controller determines to stop the reception process if the receiver is a state of not capturing the second position information satellite. That is, when the receiver is capturing only the position information satellite that transmits the leap second information at long intervals such as the GPS satellite or is not capturing the position information satellite, the controller determines to stop the reception process. In this way, a wasteful reception process can be avoided and the power consumption can be suppressed.

In the electronic timepiece according to the aspect of the invention, it is preferable that, when the leap second information cannot be acquired during the predetermined time period from the start of the reception process, the controller determines to continue the reception process to receive the second satellite signal if the receiver is in a state of capturing the second position information satellite and the reception strength of the second satellite signal is equal to or greater than a predetermined value and determines to stop the reception process if the receiver is in a state of capturing the second position information satellite and the reception strength of is less than the predetermined value.

Here, the predetermined value for determining the reception strength may be a value of approximately "30" by SNR (signal to noise ratio) for example and be set to a reception strength at which the leap second information may be accurately acquired.

According to the aspect of the invention with this configuration, the controller determines whether or not to continue the reception process of the second satellite signal, depending on whether or not the reception strength of the second satellite signal is equal to or greater than the predetermined value. That is, the controller varies the timeout time of the reception process depending on the reception strength of the second satellite signal. Here, the possibility that the leap second information is accurately acquired increases if the reception strength of the second satellite signal is equal to or greater than the predetermined value. Therefore, the reception success rate can be improved if the controller extends the timeout time of the reception process. Further, when the reception strength of the second satellite signal is low, even if the second position information satellite is being captured, there is a possibility that the leap second information cannot be accurately acquired, and thus the controller determines to stop the reception process. In this way, the wasteful reception process can be avoided and the power consumption can be suppressed.

In the electronic timepiece according to the aspect of the invention, it is preferable that, when the leap second information may not be acquired during a predetermined time period since the start of the reception process, the controller determines to continue the reception process of receiving the second satellite signal if the second satellite signal is being received while the receiver in a state of capturing the second position information satellite and determines to stop the reception process if the second satellite signal is not being received while the receiver is in a state of capturing the second position information satellite.

Here, the state where the receiver is receiving the second satellite signal means that state where the navigation message is being acquired.

According to the aspect of the invention with the configuration described above, the controller determines whether or not to continue the reception process depending on whether or not the receiver is actually receiving the second satellite signal. That is, depending on the reception status of the second satellite signal, the timeout time of the reception process can be varied. Therefore, when the second satellite signal is being received, the controller determines to continue the reception process since the possibility that the leap second information can be acquired is high if the timeout time of the reception process is extended. In this way, the reception success rate can be improved. Also, when the second satellite signal is not being received, the controller determines to stop the reception process since there is a possibility that the leap second information cannot be acquired even if the receiver is in a state of capturing the second position information satellite.

In this way, wasteful reception process can be avoided and the power consumption can be suppressed.

In the electronic timepiece according to the aspect of the invention, it is preferable that a first position information satellite is a GPS satellite and that a second position information satellite be a quasi-zenith satellite.

According to the aspect of the invention with this configuration, since the second position information satellite is a quasi-zenith satellite, the leap second information is transmitted from the second position information satellite every minute as described above. Therefore, when the reception processing times out, the reception success rate can be improved while the power consumption can be suppressed as described above by determining not to stop the reception process if the receiver is in a state of capturing the second position information satellite.

In the electronic timepiece according to the aspect of the invention, it is preferable that the receiver starts the reception process in time with the timing of the position information satellite transmitting the leap second information.

According to the aspect of the invention with this configuration, the receiver starts the reception process in time with the timing of the GPS satellite transmitting the leap second information. That is, in time with the transmission interval of the GPS satellite, the receiver starts the reception process 12.5 minutes after the last time the GPS satellite transmitted the satellite signal. Therefore, it is possible to prevent the reception process from being executed in a state where the leap second information is not transmitted from the GPS satellite, improve the reception success rate and suppress the power consumption.

It is preferable that the electronic timepiece according to the aspect of the invention further includes a timekeeper that keeps the internal time information, the receiver executes a time information reception process to capture the position information satellite transmitting the time information and receives the satellite signal transmitted from the captured position information satellite, the controller executes the time measurement process to acquire the time information on the basis of the satellite signal received by the receiver and a time correction process to correct the internal time information on the basis of the time information acquired by the time measurement process, and the receiver determines the timing of the position information satellite transmitting the leap second information on the basis of the internal time information corrected by the time correction process and starts the reception process in time with the determined timing.

According to the aspect of the invention with this configuration, the controller acquires the time information on the basis of the satellite signal received by the receiver and corrects the internal time information. Therefore, the receiver can accurately grasp the timing of the position information satellite transmitting the leap second information. Therefore, the receiver can be prevented from starting the reception process at a timing when the position information satellite does not transmit the leap second information and the reception success rate can be improved.

BRIEF DESCRIPTION OF THE DRAWINGS

The invention will be described with reference to the accompanying drawings, wherein like numbers reference like elements.

FIG. 5 is a diagram describing the configuration of a sub-frame 1.

FIG. 6 is a diagram describing the configuration of the navigation message of a quasi-zenith satellite.

DESCRIPTION OF EXEMPLARY EMBODIMENTS

First Embodiment

Hereinafter, the electronic timepiece 1 according to a first embodiment will be described on the basis of the drawings.

Figure 1:
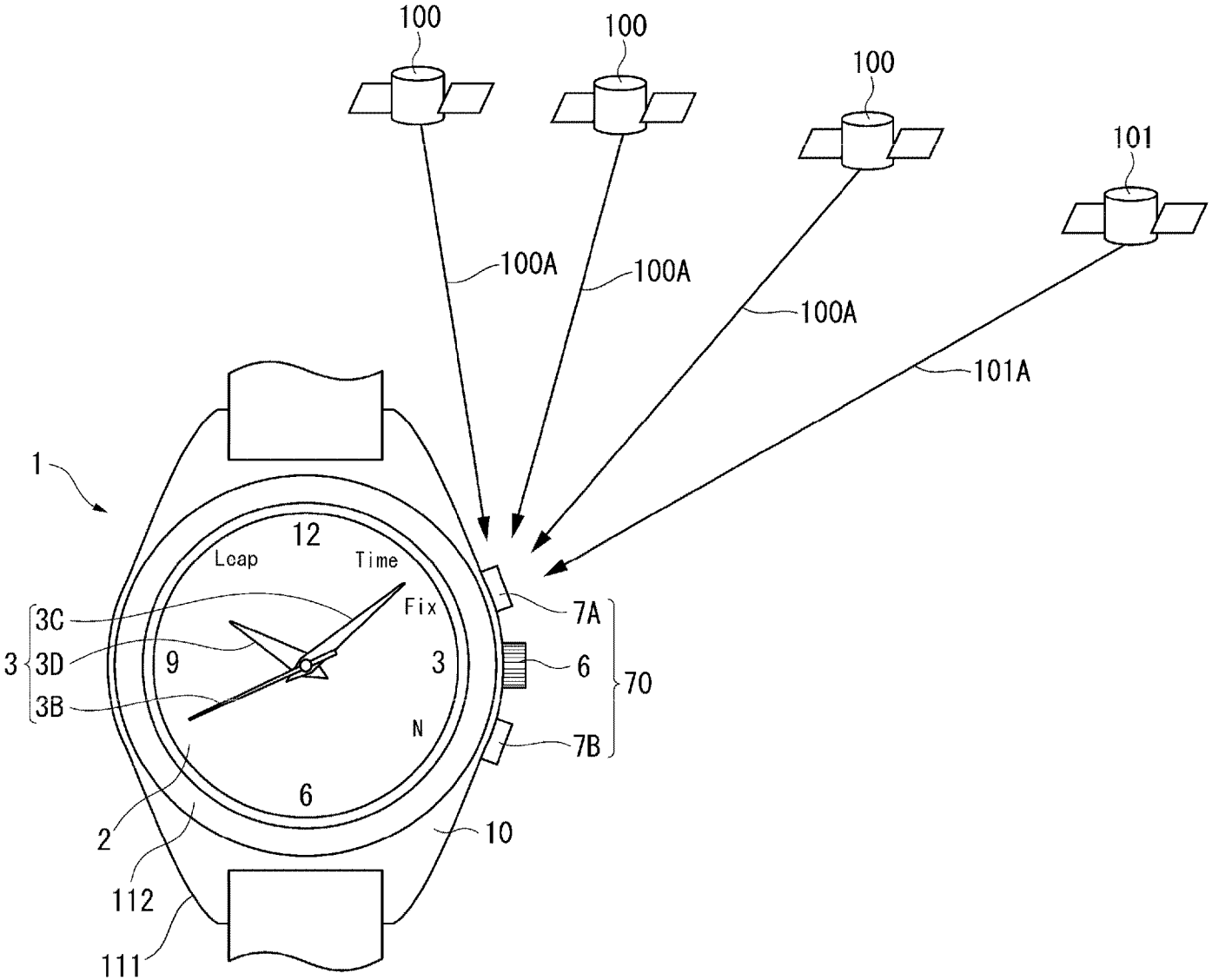
FIG. 1 is a schematic diagram showing an electronic timepiece according to the invention.
Figure 2:
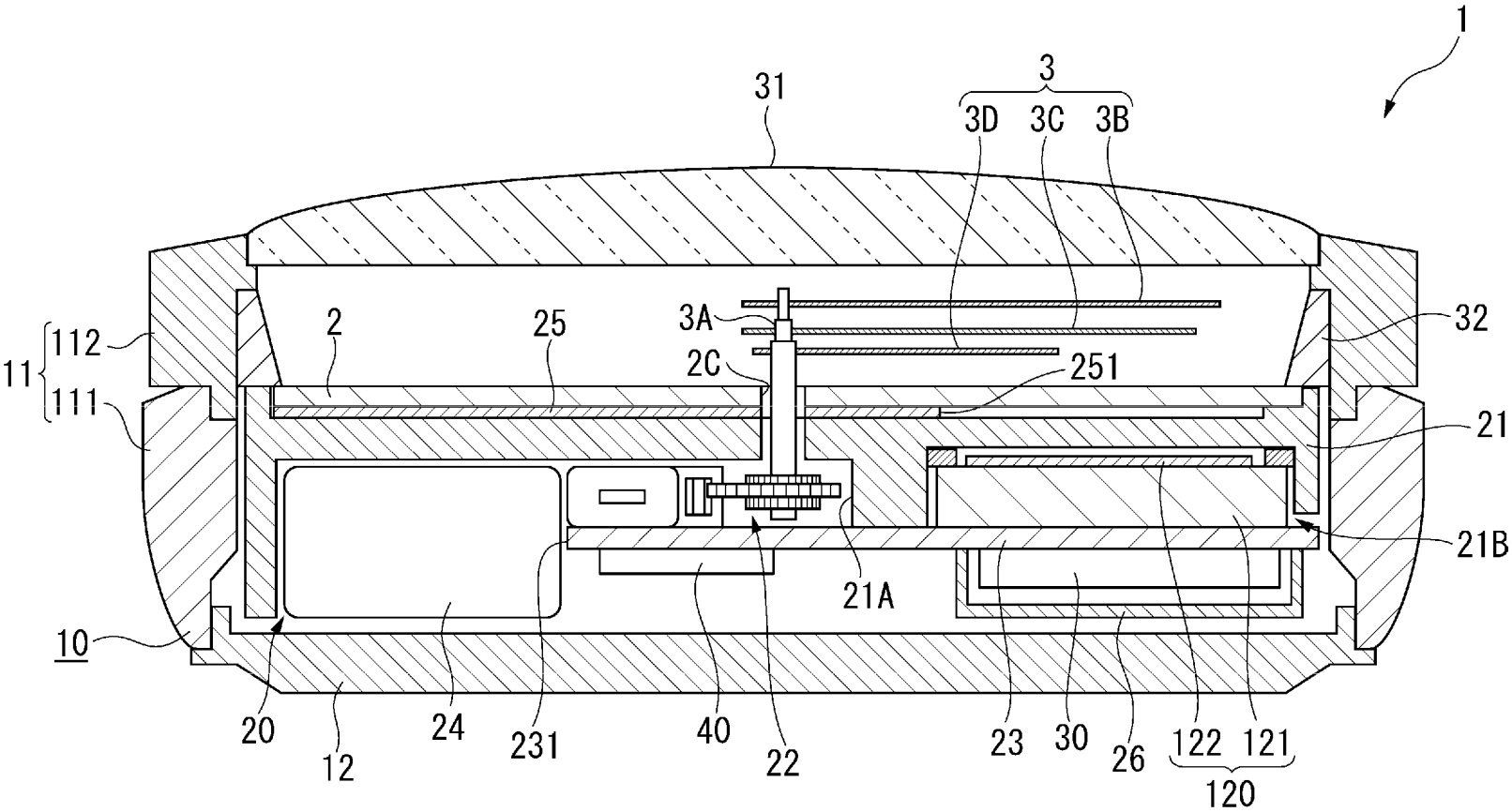
FIG. 2 is a schematic section view of the electronic timepiece.

FIG. 1 is a schematic view showing the electronic timepiece 1 of the first embodiment, and FIG. 2 is a schematic section view of the electronic timepiece 1.

The electronic timepiece 1 is configured to receive the satellite signal transmitted from at least one position information satellite among the position information satellites orbiting around the earth in a predetermined orbit so as to acquire the time information and receive the satellite signal transmitted from at least three, preferably four, position information satellites so as to calculate and acquire the position information.

Here, the position information satellites include GNSS satellite which is a position information signal of the global navigation satellite system (GNSS) and RNSS which is a position information signal of the regional navigation satellite system (RNSS).

Examples of the global navigation satellite system include GPS (US), GLONASS (Russia), Galileo (European Union), and Beidou (China). Also, examples of regional navigation satellite system include quasi-zenith satellite system (QZSS; Japan), IRNSS (India), DORIS (France) and Beidou (China).

In the embodiment, GPS and QZSS are described as examples of GNSS AND RNSS respectively. Therefore, in the following embodiment, the GPS satellite 100 shown in FIG. 1 will be described as an example of the first position information satellite and the quasi-zenith satellite 101 will be described as an example of the second position information satellite.

Electronic Timepiece

The electronic timepiece 1 is a wrist watch to be worn on the user's wrist and is equipped with a dial 2 and a hand 3 and keeps and displays the time.

Most of the dials 2 are formed of a nonmetallic material (for example, plastic or glass) which is easy to transmit light and microwaves of 1.5 GHz band through. As shown in FIG. 2, a through hole 2C through which a hand shaft 3A of the hand 3 is inserted is formed in the dials 2. The through hole 2C is formed at the center position of the plane of the dial 2.

The hand 3 is provided on the front surface side of the dial 2. Also, the hand 3 includes a second hand 3B, a minute hand 3C and an hour hand 3D rotating and moving around the hand shaft 3A and is driven by a motor through a gear.

Operation of Operation Unit

In the electronic timepiece 1, a processing corresponding to a manual operation of an input device 70 having a crown 6, a button 7A, and a button 7B is executed. Specifically, if the crown 6 is operated, manual correction processing for correcting the display time is executed in accordance with the operation. Also, if the button 7A is pushed for a long time (for example, time of three seconds or longer), manual reception processing (forced reception processing) of receiving the satellite signal is executed.

Also, if the button 7B is pushed, switch processing of switching the reception modes (time measurement mode and position mode) is executed.

The time measurement mode is a mode in which one or more GPS satellites 100 are captured, the satellite signal is received, and the time information is acquired from the received satellite signals.

The positioning mode is a mode in which three or more GPS satellites 100 are captured, the satellite signal is received, and the position information is acquired by the positioning operation based on the received satellite signals. Normally, the time information can also be acquired from the satellite signal at the same time in the positioning mode. However, the time information may not be acquired from the satellite signals.

The setting of the reception mode by the operation of the button 7B is stored in a reception mode storage unit 660 of the storage device 60 to be described later. Then, when the time measurement mode is set, the second hand 3B moves to the position of "Time" (five second position), and when the positioning mode is set, the second hand 3B moves to the position of "Fix" (ten second position). Therefore, a user can easily identify the set reception mode.

The reception mode is not limited to the indication by the second hand 3B, but a hand (mode hand) for indicating the mode may be separately provided and displayed.

If the button 7A is pushed for a short time period (for example, less than three seconds), a result display processing of displaying the result of the last reception processing is performed. That is, when the reception is successful in the positioning mode, the second hand 3B moves to the position of "Fix" (ten second position), and when the reception is successful in the time measurement mode, the second hand 3B moves to the position of "Time" (five second position). Also, when the reception fails, the second hand 3B moves to the position of "N" (20 second position).

Also, when a leap second reception condition to be described later is satisfied, the display switch processing of switching the display on a display device 90 to be described later is executed if the button 7A is pushed during the reception standby for the leap second information. The switch processing may be executed by the button 7B being pushed instead of the button 7A.

Exterior Structure of Electronic Timepiece

As shown in FIGS. 1 and 2, the electronic timepiece 1 includes an exterior case 10 that accommodates a movement 20 and the like. The exterior case 10 includes a case main body 11 and a case back cover 12.

The case main body 11 includes a cylindrical case band 111 and a bezel 112 provided on a front surface side of the case band 111.

The bezel 112 is formed in a ring shape. The bezel 112 and the case band 111 are connected to each other by an engaging structure of protrusions and recesses formed on the surfaces facing each other or by the means such as a double-sided adhesive tape, an adhesive, or the like. The bezel 112 may be rotatably attached to the case band 111.

Also, a cover glass 31 supported by the bezel 112 may be attached to the inner side of the bezel 112.

A disk-shaped case back cover 12 that closes an opening on the back surface side of the case main body 11 is provided on the back surface side of the case main body 11. The case back cover 12 is connected to the case band 111 of the case main body 11 by a screw structure.

In the present embodiment, the case band 111 and the case back cover 12 are configured to be separate bodies but are not limited thereto, and the case band 111 and the case back cover 12 may be integrated into a one-piece case.

Conductive metallic materials such as BS (brass), SUS (stainless steel), and titanium alloy are used for the case band 111, the bezel 112, and the case back cover 12.

Internal Structure of Electronic Timepiece

Next, the internal structure built in the exterior case 10 of the electronic timepiece 1 will be described.

As shown in FIGS. 1 and 2, in addition to the dial 2, a movement 20, a planar antenna (patch antenna) 120, a dial ring 32 and the like are accommodated in the exterior case 10.

The movement 20 includes a main plate 21, a drive mechanism 22 supported by the main plate 21, a printed circuit board 23, a secondary battery 24, and a solar panel 25.

The main plate 21 is formed of a non-conductive member such as plastic or the like. The main plate 21 includes a drive mechanism accommodation unit 21A for accommodating the drive mechanism 22 and an antenna accommodation unit 21B for accommodating the planar antenna 120. The drive mechanism accommodation unit 21A and the antenna accommodation unit 21B are provided on the back surface side of the main plate 21.

The drive mechanism 22 is accommodated in the drive mechanism accommodation unit 21A of the main plate 21 and drives the hand 3.

The printed circuit board 23 is formed in an approximately circular planar shape, and an approximately circular notch 231 where the secondary battery 24 is disposed is formed. The front surface of the printed circuit board 23, which is the surface on the dial 2 side, is brought into contact with the back surface of the main plate 21 and fixed to the main plate 21 by a screw or the like. The planar antenna 120 is mounted on the front surface side of the printed circuit board 23. Also, a reception device 30 serving as a receiver for receiving the satellite signal transmitted from the GPS satellite 100 and quasi-zenith satellite 101, a control device 40 serving as a controller for controlling the electronic timepiece 1, and a power supply IC (not shown) are mounted on the back surface side of the printed circuit board 23.

In the present embodiment, since the reception device 30, the control device 40 and the power supply IC are disposed on the opposite side of the printed circuit board 23 from the planar antenna 120, the digital noise generated from the reception circuit and the power supply circuit hardly jumps into the planar antenna 120, and the reception sensitivity can also improve.

Further, since the reception device 30 is surrounded by a shield plate 26, the reception device 30 is not affected by the noise generated by the control device 40.

The secondary battery 24 is a button type lithium ion battery formed in a planar circular shape. The secondary battery 24 supplies electric power to the drive mechanism 22, the reception device 30, the control device 40, and the like. The secondary battery 24 is provided at the notch 231 of the printed circuit board 23.

The solar panel 25 has a surface electrode formed of a transparent electrode such as ITO (Indium Tin Oxide) for light transmission. Also, a thin film of an amorphous silicon semiconductor is formed as a power generation layer on a base composed of a resin film.

Since the frequency of the GPS satellite signal, approximately 1.5 GHz, is a high frequency, the radio wave attenuates even by a thin transparent electrode unlike the standard long-wave radio wave received by a radio wave timepiece, and the antenna characteristics are impaired. Therefore, the solar panel 25 formed in a circular shape has a notch 251 formed at a portion overlapping with the planar antenna 120 in a plan view. Therefore, the solar panel 25 is disposed on the front surface side of the main plate 21, not on the front surface side of the planar antenna 120. Therefore, the planar antenna 120 can receive radio wave through the notch 251 of the solar panel 25.

A planar antenna 120 which is a patch antenna (micro strip antenna) is disposed in the antenna accommodation unit 21B. The planar antenna 120 receives the first satellite signal 100A transmitted from the GPS satellite 100 and the second satellite signal 101A transmitted from the quasi-zenith satellite 101. Details of the planar antenna 120 will be described later.

On the front surface side of the main plate 21, the dial 2 is disposed so as to cover the front surface side of the solar panel 25. A dial ring 32, which is a ring member formed of a synthetic resin (for example, ABS resin) which is a nonconductive member, is provided on the front surface side of the dial 2. The dial ring 32 is arranged along the circumference of the dial 2. If the dial ring 32 is molded with plastic, it is possible to secure the reception performance and to form a complicated shape so as to improve the designability. The dial ring 32 is pushed to the side of the dial plate 2 to be supported by the bezel 112.

Planar Antenna

The planar antenna 120 overlaps with the dial 2 and the cover glass 31, formed of a nonconductive member, without overlapping with the case main body 11 (the case band 111 and bezel 112) and the solar panel 25 in plan view.

Therefore, after passing through the cover glass 31, the satellite signal propagated from the clock front surface side passes through the dial 2 and the main plate 21 without being blocked by the case main body 11 or the solar panel 25 and enters the planar antenna 120. Since the area in which the hand 3 overlaps with the planar antenna 120 is small, the hand 3 does not interfere with the reception of the satellite signal even the hand 3 is made of metal, but it is preferable that the hand 3 is made of a nonconductive member such that it is possible to avoid the effect of the satellite signal being blocked.

The GPS satellite 100 transmits a first satellite signal 100A in right-handed circular polarized waves. Therefore, the planar antenna 120 of the present embodiment is configured with a patch antenna (also referred to as a micro strip antenna) excellent in circular polarized wave characteristics.

The planar antenna 120 of the present embodiment is a patch antenna in which a conductive antenna electrode 122 is laminated on a ceramic dielectric substrate 121.

This planar antenna 120 can be manufactured as follows. First, barium titanate having a relative permittivity of about 60 to 100 is used as the main material to be formed into a target shape by a press machine, and ceramics to be used as dielectric substrate 121 of the antenna are completed through firing. The GND electrode (not shown) serving as the ground (GND) of the antenna is formed by the printing of a paste material, mostly silver (Ag), on the back surface (the surface on the printed circuit board 23 side) of the dielectric substrate 121.

An antenna electrode 122 for determining the frequency of the antenna and the polarized wave of the signal to be received is formed on the front surface of the dielectric substrate 121 (surface on the main plate 21 and the dial 2 side) in the same way as the GND electrode.

The planar antenna 120 is mounted on the front surface of the printed circuit board 23 and is electrically connected to the antenna GPS module which is the reception device 30 of the back surface of the printed circuit board 23. Further, the printed circuit board 23 functions as a ground plane (ground plane) by the GND electrode of the planar antenna 120 being conducted to the ground unit of the reception device 30 through the ground pattern of the printed circuit board 23. Further, the case band 111 and the case back cover 12 can also be used as the ground plane by the ground unit of the reception device 30 being conducted to the metal case band 111 and the case back cover 12 through the ground pattern of the printed circuit board 23.

The planar antenna 120 is disposed in the antenna accommodation unit 21B by the printed circuit board 23 being fixed to the main plate 21.

Circuit Configuration of Electronic Timepiece

Figure 3:
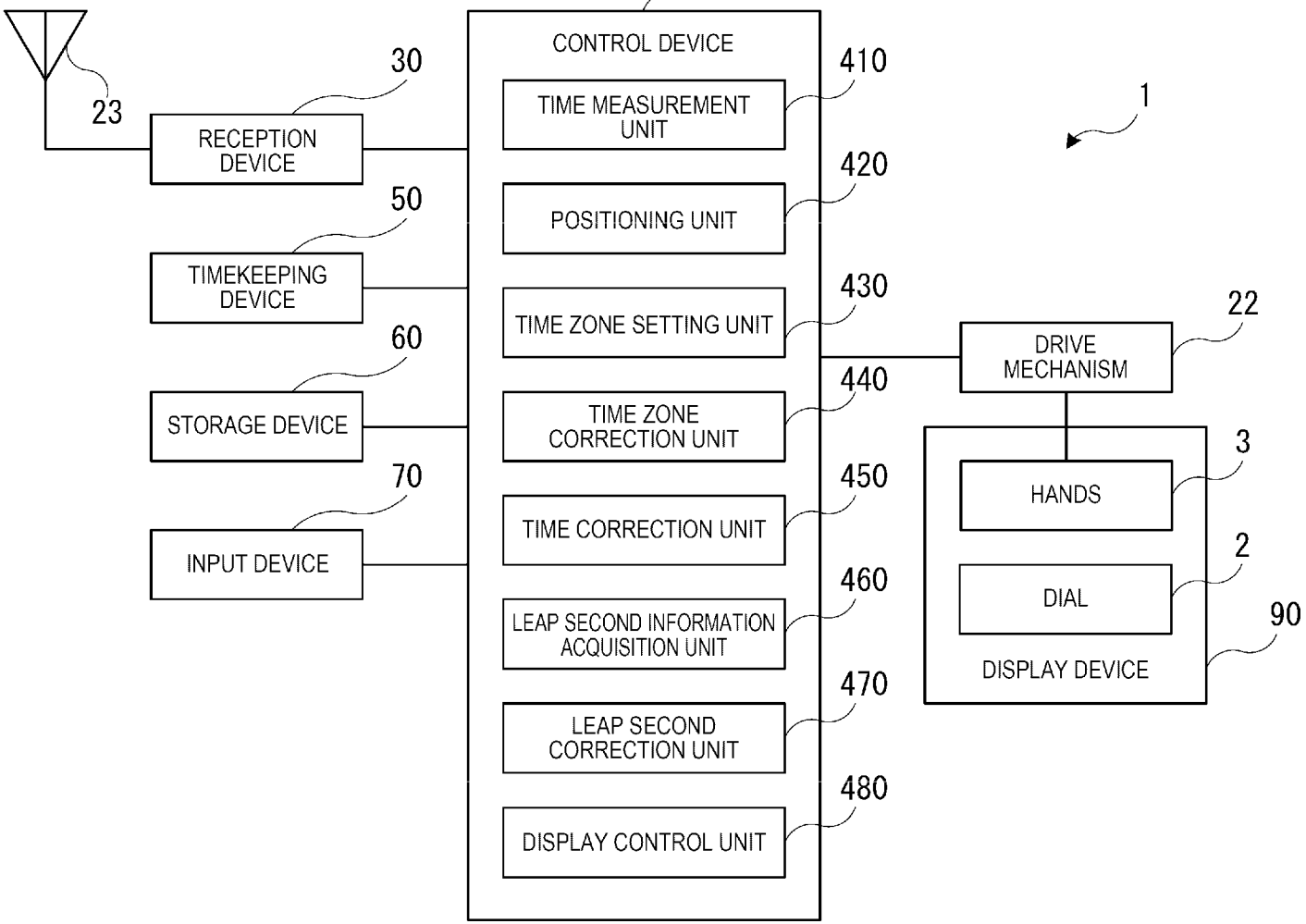
FIG. 3 is a block diagram showing a configuration of the electronic timepiece.

FIG. 3 is a block diagram showing the configuration of the electronic timepiece 1. The electronic timepiece 1 includes the reception device 30 (receiver), the control device 40, a timekeeping device 50 (timekeeper), a storage device 60, an input device 70, and a display device 90.

Reception Device

The reception device 30 is a load driven by electric power stored in the secondary battery 24. If driven by the control device 40, the reception device 30 captures the GPS satellite 100 and quasi-zenith satellite 101 (refer to FIG. 1) through the planar antenna 120 and executes the reception processing of receiving the first satellite signal 100A transmitted from the captured GPS satellite 100 and the second satellite signal 101A transmitted from the captured quasi-zenith satellite 101. That is, the reception device 30 is an example of the receiver. Then, when the reception of the satellite signal is successful, the reception device 30 transmits the information such as the acquired orbit information, the GPS time information, and the like to the control device 40. On the other hand, when the reception of the satellite signal fails, the reception device 30 transmits the information to that effect to the control device 40. The configuration of the reception device 30 is the same as the configuration of the known GPS reception circuit. That is, the reception device 30 includes an RF (Radio Frequency) unit that receives satellite signal transmitted from the GPS satellite 100 and the quasi-zenith satellite 101 and converts the satellite signal into digital signals, BB unit (base band unit) that executes a correlation determination of the received signal so as to demodulate the navigation message, and information acquisition means that acquires the time information and the position information (positioning information) from the navigation message (satellite signal) demodulated by the BB unit and outputs the information.

Navigation Message of GPS Satellite

Figure 4A:
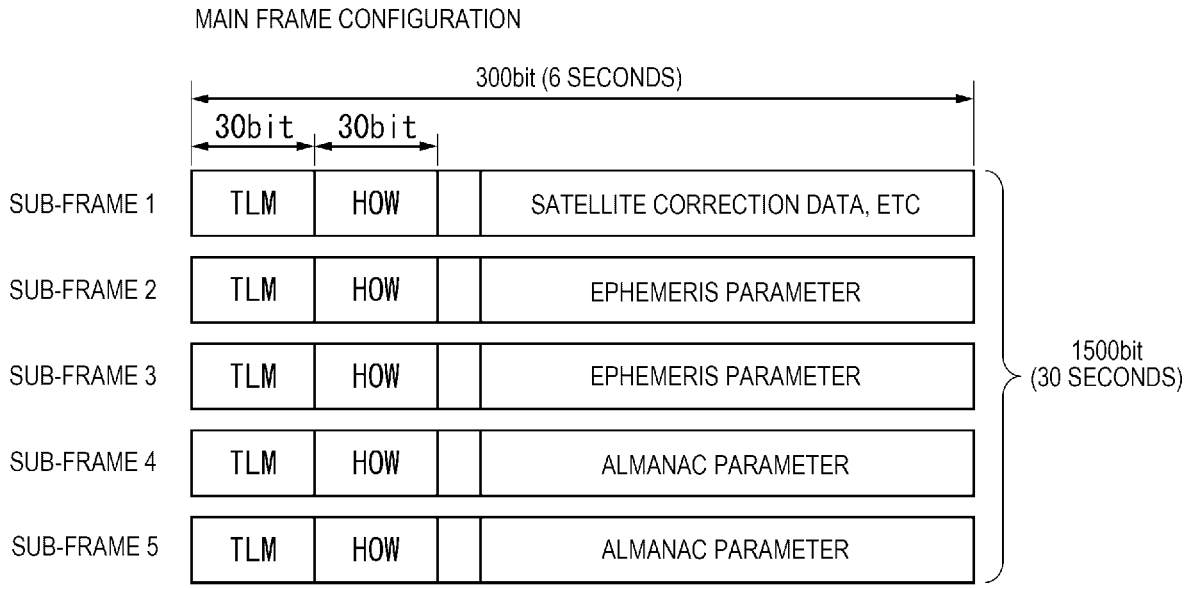
FIGS. 4A to 4C are diagrams describing the configuration of a navigation message of a GPS satellite.
Figure 4B:
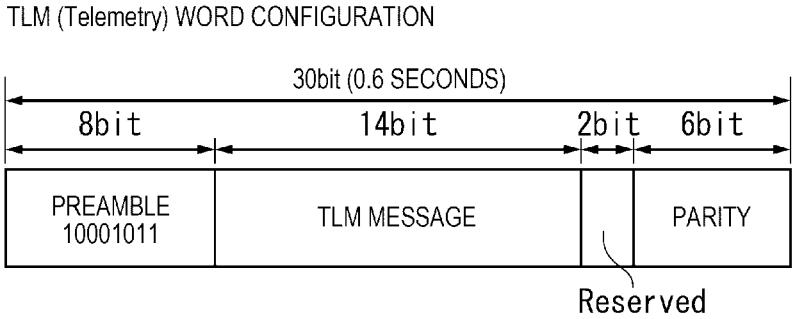
Figure 4C:
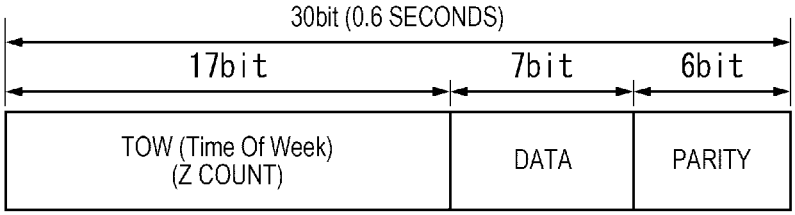

FIGS. 4A to 4C are diagrams describing the configuration of the navigation message included in the first satellite signal 100A transmitted from the GPS satellite 100.

As shown in FIG. 4A, the navigation message is configured as data having a main frame of a total of 1,500 bits as one unit. The main frame is divided into five sub-frames 1 to 5 of 300 bits respectively. One sub-frame data is transmitted from each GPS satellite 100 in six seconds. Therefore, the data of one main frame is transmitted from each GPS satellite 100 in 30 seconds.

As shown in FIG. 5, the sub-frame 1 includes satellite correction data including the weekly number data (WN) and the satellite health condition (SV health). The weekly number data is information representing the week in which the present GPS time information is included. The GPS time information originates from 00:00:00 on Jan. 6, 1980 in UTC (Coordinated Universal Time), and the week beginning on this day is the week number 0. The week number data is updated on a weekly basis.

The satellite health condition (SV health) is a code that shows whether or not the satellite is abnormal, and the checking this code enables the control to ignore the signal of the satellite that is abnormal. Specifically, "0" satellite health condition shows that the navigation message is normal, and "1" satellite health condition shows that a part or the whole of the navigation messages are abnormal.

Then, since the sub-frames 1 to 3 out of the five sets of sub-frames contain information unique to each satellite, the same content is repeatedly transmitted each time. Specifically, the clock correction information and the orbit information (ephemeris) of the transmitting satellite itself are included. In contrast, the sub-frames 4 and 5 include the orbit information (almanac) and ionosphere correction information of all satellites. Since the number of data is large, the data is divided into pages and accommodated in the sub-frames.

That is, the data transmitted by the sub-frames 4 and 5 are divided into pages 1 to 25 respectively, and the contents of different pages for each frame are transmitted sequentially. Since 25 frames are required to transmit the contents of all the pages, it takes 12 minutes and 30 seconds to receive all the information of the navigation message.

Further, the sub-frames 1 to 5 include a TLM (Telemetry) word storing TLM (Telemetry word) data of 30 bits and HOW (hand over word) word storing HOW data of 30 bits from the top down.

Therefore, the TLM word and the HOW word are transmitted at the intervals of six seconds from the GPS satellite 100, while the satellite correction data such as weekly number data, the ephemeris parameter, and the almanac parameter are transmitted at the intervals of 30 seconds.

As shown in FIG. 4B, TLM word includes the preamble data, the TLM message, the reserved bit, and the parity data.

As shown in FIG. 4C, the HOW word includes the GPS time information of TOW (Time of Week, also known as "Z count"). The Z count data shows the lapse of time in seconds since the zero o'clock of Sunday each week and returns to zero at 0 o'clock on Sunday the next week. That is, the Z count data is the information presented in seconds since the beginning of the week every week. This Z count data is the GPS time information to which the leading bit of the next sub-frame data is transmitted. For example, the Z count data of the sub-frame 1 is the GPS time information to which the leading bit of the sub-frame 2 is transmitted. Further, the HOW word also includes three bit data (ID code) representing the ID of the sub-frame.

Also, the leap second information is stored on page 18 of the sub-frame 4. That is, various data relating to the leap second such as "current leap second $\Delta t_{LS}$", "leap second update week $WN_{LSF}$", "leap second update data DN", and "post-update leap second $\Delta t_{LSF}$" are stored on the page 18 of the sub-frame 4 of the satellite signal.

The "leap second update week, leap second update date, and post-update leap second" are information necessary for the next leap second update processing. When it is determined to execute the leap second update, the data is updated for about six months prior to the update data to form new data. Then, the data remains unchanged even after the leap second update is executed, and, therefore, remains the same value until the execution of the next leap second update is determined. Therefore, it can be determined that there is no schedule of an update if $\Delta t_{LS}$ and $\Delta t_{LSF}$ are the same value and that there is a schedule of an update if $\Delta t_{LS}$ and $\Delta t_{LSF}$ are different values.

Further, since the time information (Z count) is stored in all sub-frames, the time information can be received every six seconds.

Therefore, in a state where the calendar is not set after a system reset, it is necessary to grasp the year, month, and date information by receiving the sub-frame 1 transmitted every 30 seconds and acquiring the week number and satellite health condition. Also, in order to calculate UTC from the GPS time calculated from the week number and the Z count, it is necessary to receive the page 18 of the sub-frame 4 transmitted every 12.5 minutes and grasp the information of "current leap second". That is, the interval of 12.5 minutes at which the page 18 of the sub-frame 4 including the leap second information is transmitted is an example of the first interval.

On the other hand, after the acquisition of the week number and the current leap second, it is possible to count the lapse of time since the week number is acquired, such that the current week number of the GPS satellite 100 can be obtained from the acquired week number and the lapse of time without acquiring the week number again. Therefore, if the Z count alone is acquired, the current GPS time can be acquired and the UTC can be obtained by the correction of the current GPS time with the current leap second information.

Navigation Message of Quasi-Zenith Satellite

FIG. 6 is a diagram for describing the structure of the navigation message included in the second satellite signal 101A transmitted from the quasi-zenith satellite 101.

As shown in FIG. 6, the UTC parameter is stored in the sub-frame 4 or the sub-frame 5, and leap second information is included in the UTC parameter. That is, each data such as "current leap second $\Delta t_{LS}$", "leap second update week $WN_{LSF}$", "leap second update data DN", and "post-update leap second $\Delta t_{LSF}$" is stored in the sub-frame 4 or the sub-frame 5.

Also, since the UTC parameter is delivered at intervals of up to 60 seconds, the leap second information can be acquired every 60 seconds (one minute) from the second satellite signal 101A. In this way, the leap second information is transmitted from the quasi-zenith satellite 101 at the intervals shorter than the intervals of the GPS satellite 100. That is, the interval of one minute at which the UTC parameter that includes the leap second information is transmitted is an example of the second interval.

Timekeeping Device

The timekeeping device 50 includes a crystal oscillator or the like driven by electric power accumulated in the secondary battery 24 and updates the time data by using a reference signal based on the oscillation signal of the crystal oscillator.

Display Device

The display device 90 is configured with the hand 3 and the dial 2 and displays the time.

Input Device

If the button 7A is operated, the input device 70 detects the operation of the button 7A and outputs a display switch instruction for switching the displays of the display device 90.

Storage Device

Figure 7:
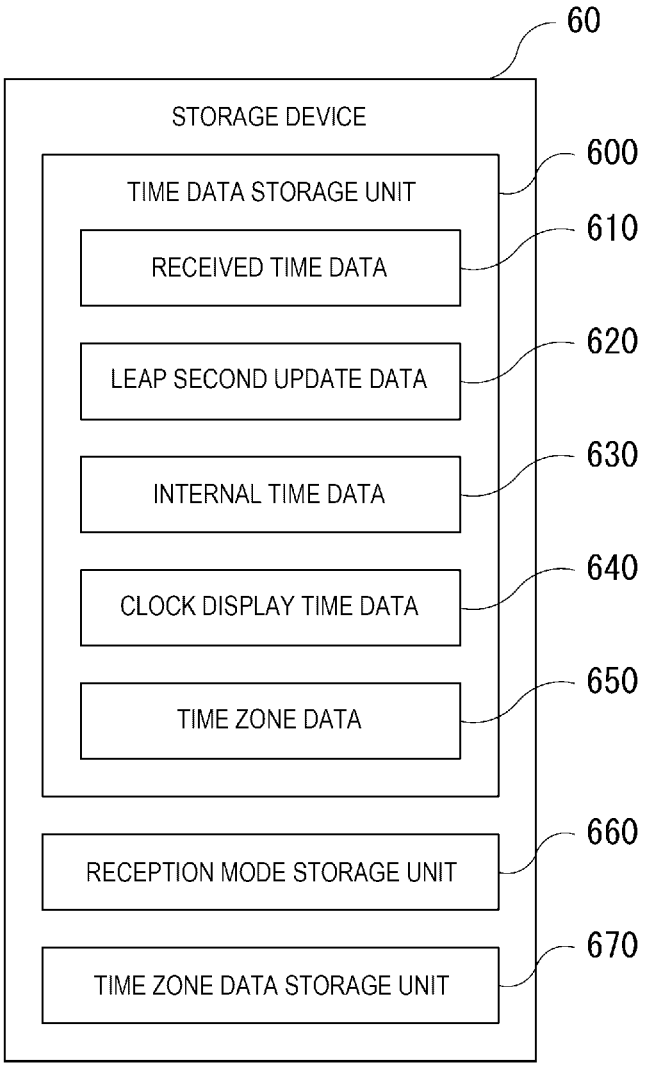
FIG. 7 is a block diagram showing the configuration of a storage device.

As shown in FIG. 7, the storage device 60 includes a time data storage unit 600, a reception mode storage unit 660, and a time zone data storage unit 670.

Received time data 610, leap second update data 620, internal time data 630, clock display time data 640, and time zone data 650 are stored in the time data storage unit 600.

The time information acquired from the satellite signal is stored in the received time data 610. The received time data 610 is normally updated every second by the timekeeping device 50 and corrected by the acquired time information when the satellite signal is received.

At least the current leap second data is stored in the leap second update data 620. Also, when each data of "leap second update week, leap second update date, and post-update leap second" is acquired, the data are also stored in the leap second update data 620.

The internal time information is stored in the internal time data 630. The internal time information is updated by the GPS time information stored in the received time data 610 and the "current leap second" stored in the leap second update data 620. That is, the UTC (Coordinated Universal Time) is stored in the internal time data 630. When the received time data 610 is updated by the timekeeping device 50, the internal time information is also updated.

The time data in which the time zone data (time zone information and time difference information) of the time zone data 650 is added to the internal time information of the internal time data 630 is stored in the clock display time data 640. The time zone data 650 is set by the position information or the like acquired when the reception is made in the positioning mode.

As described above, the reception mode storage unit 660 stores the reception mode set by the operation of the button 7B.

The time zone data storage unit 670 stores the position information (latitude and longitude) and the time zone information (time difference information) in association with each other. Therefore, when position information is acquired in the positioning mode, the control device 40 can acquire time zone data on the basis of the position information (latitude and longitude).

Further, the time zone data storage unit 670 may store the city name and the time zone data in association with each other. In this case, if the user selects the name of a city of which the user wants to know the local time by the operation of the input device 70, the control device 40 may retrieve the name of the city set by the user in the time zone data storage unit 670, acquire the time zone data corresponding to the city name, and set the data to the time zone data 650.

Control Device

Returning to FIG. 3, the control device 40 is configured with a CPU for controlling the electronic timepiece 1. The control device 40 includes a time measurement unit 410, a positioning unit 420, a time zone setting unit 430, a time zone correction unit 440, a time correction unit 450, a leap second information acquisition unit 460, a leap second correction unit 470, and a display control unit 480. The control device 40 is an example of the controller.

Time Measurement Unit

The time measurement unit 410 operates the reception device 30 to perform time information reception processing in the time measurement mode. In the present embodiment, the reception processing is executed in the time measurement mode by automatic reception processing and manual reception processing.

There are two types of automatic reception processing: fixed-time automatic reception processing and optical automatic reception processing. That is, when the scheduled reception time period comes according to the fixed-time clock display time data 640 kept by the time measurement unit 410, the time measurement unit 410 operates the reception device 30 and performs the fixed-time automatic reception processing in the time measurement mode.

Also, when it is determined that the voltage or the current generated by the solar panel 25 is equal to or greater than the set value and that the solar panel 25 is irradiated with the sunlight outdoors, the time measurement unit 410 operates the reception device 30 to perform the optical automatic reception processing in the time measurement mode. It should be noted that the number of times the reception device 30 is operated while the solar panel 25 is generating may be limited to once a day or the like.

Further, when the user pushes the button 7A of the input device 70 and performs the forced reception operation while the time measurement mode is set, the time measurement unit 410 operates the reception device 30 and performs the manual reception processing in the time measurement mode.

The time measurement unit 410 captures at least one GPS satellite 100 by the reception device 30, receives the satellite signal transmitted from the GPS satellite 100 and acquires the time information.

Positioning Unit

When the user pushes the button 7A of the input device 70 and operates the forced reception operation while the positioning mode is set, the positioning unit 420 operates the reception device 30 and performs the reception processing in the positioning mode.

Regardless of the reception mode stored in the reception mode storage unit 660, the control device 40 may switch between the reception processing by the time measurement unit 410 in the time measurement mode and the reception processing by the positioning unit 420 in the positioning mode, depending on the time period in which the button 7A is pushed. For example, the control device 40 may perform the reception processing in the time measurement mode when the button 7A is pushed for three seconds or longer and for less than six seconds and may perform the reception processing in positioning mode when the button 7A is pushed for six seconds or longer.

If the reception processing is started in the positioning mode, the positioning unit 420 captures at least three, preferably four or more, GPS satellites 100 by the reception device 30, receives the satellite signal transmitted from each GPS satellite 100, and calculates and acquires the position information. Further, the positioning unit 420 can also acquire the time information at the same time when the satellite signal is received.

Time Zone Setting Unit

When the acquisition of the position information by the positioning unit 420 is successful, the time zone setting unit 430 sets the time zone data on the basis of the acquired position information (latitude and longitude). Specifically, the time zone setting unit 430 selectively acquires the time zone data (time zone information and time difference information) corresponding to the position information from the time zone data storage unit 670 and stores the time zone data in the time zone data 650.

For example, since Japan Standard Time (JST) is nine hours ahead of the UTC (UTC+9), when the positioning unit 420 acquires the position information in Japan, the time zone setting unit 430 reads the time difference (+nine hours) of the Japan Standard Time from the time zone data storage unit 670 and store the difference in the time zone data 650.

Time Zone Correction Unit

If the time zone setting unit 430 sets the time zone information, the time zone correction unit 440 corrects the clock display time data 640 using the time zone data. Therefore, the clock display time data 640 is acquired by adding time zone data to the internal time data 630 which is the UTC.

Time Correction Unit

When the acquisition of time information by the reception processing of the time measurement unit 410 and the positioning unit 420 is successful, the time correction unit 450 corrects the received time data 610 with the acquired time information. Therefore, the internal time data 630 and the clock display time data 640 are also corrected.

Leap Second Information Acquisition Unit

In a case where the leap second reception condition is satisfied, when the reception processing is performed by the time measurement unit 410 and the positioning unit 420, the leap second information acquisition unit 460 continues to acquire the time information by the time measurement unit 410 and the positioning unit 420 and operates the reception device 30 so as to acquire the leap second information.

The leap second reception condition is satisfied when the leap second information is not stored in the leap second update data 620 and when the reception of the leap second information is not successful in the reception period according to the internal time information stored in the internal time data 630.

In the present embodiment, the leap second reception period is set to every six months. The leap second is updated at least every six months at present and was updated once in one to several years in recent years. Also, the first priority dates of the specific leap second update are the last days of December and June. Further, the leap second information also includes the next leap second update data and post-update leap second information.

Therefore, if leap second information is received every six months (specifically June and December), it can also be determined whether or not the leap second update is scheduled in the next six months.

Therefore, the leap second information acquisition unit 460 performs the acquisition processing of the leap second information on the basis of the determination that the leap second reception condition is satisfied in a case where the calendar date of the internal time information stored in the internal time data 630 falls on the periods of June 1 to 30 and December 1 to 31 and the reception of the leap second information is not successful during the period.

Since the leap second reception period may be half a year after the leap second information update, the period is not limited to June and December and may be set every six months like July and January, or August and February.

The leap second information acquisition unit 460 captures at least one GPS satellite 100 with the reception device 30, receives the satellite signal transmitted from the GPS satellite 100 and acquires the leap second information. The details of the leap second information acquisition unit 460 will be described in the reception processing of the leap second information.

Leap Second Correction Unit

The leap second correction unit 470 corrects the leap second information stored in the leap second update data 620, using the leap second information acquired by the leap second information acquisition unit 460.

Display Control Unit

The display control unit 480 displays the time shown in the clock display time data 640 on the display device 90. That is, the display control unit 480 moves the hand 3 by controlling the drive mechanism 22 and displays the time on the display device 90.

Reception Processing of the Leap Second Information

Figure 8:
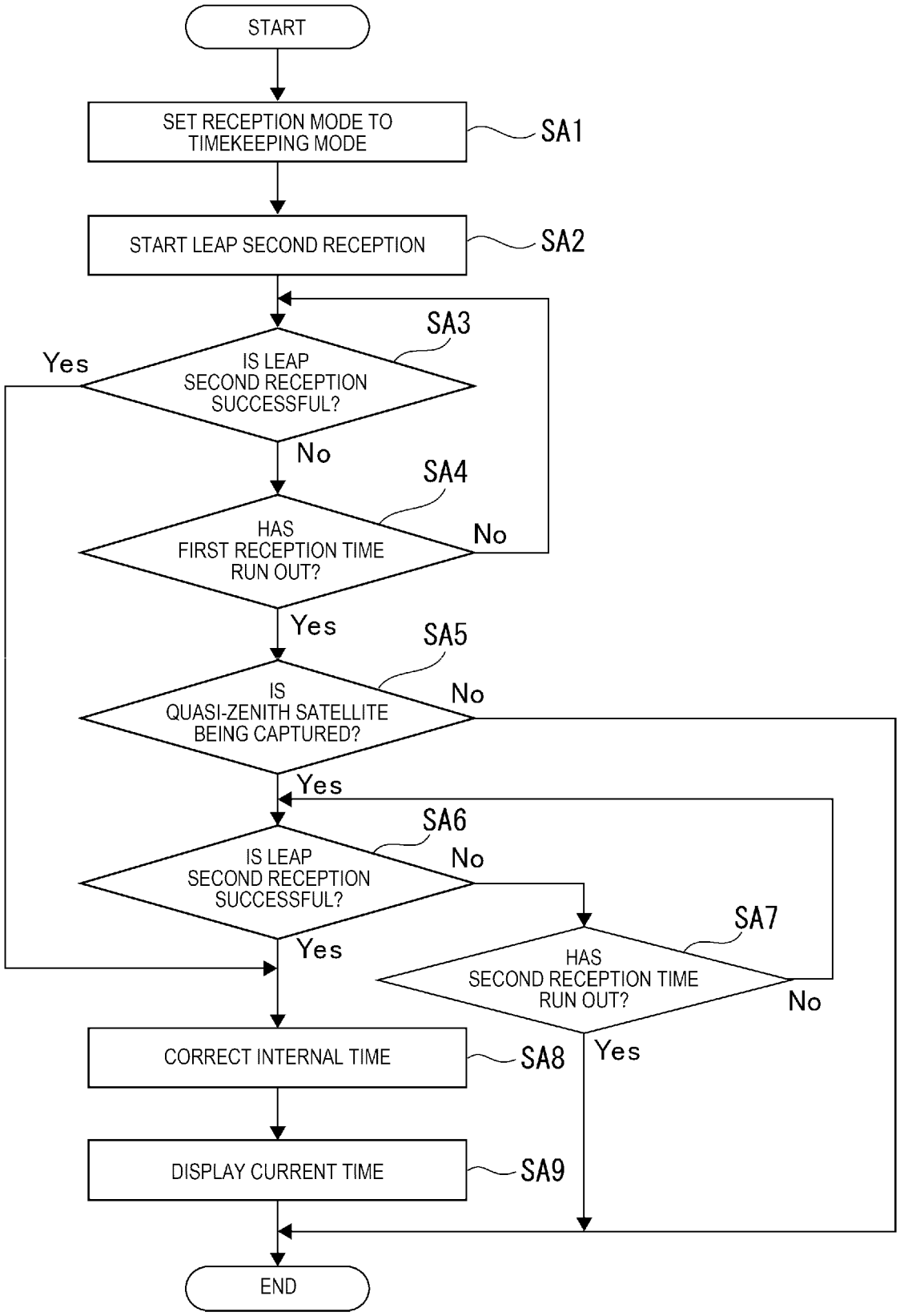
FIG. 8 is a flowchart showing a reception processing of leap second information in accordance with a first embodiment.

FIG. 8 is a flowchart showing the reception processing of the leap second information of the electronic timepiece 1 in the first embodiment.

When the leap second reception condition described above is satisfied, the control device 40 determines that the condition for executing the leap second reception is satisfied and sets the reception mode to the time measurement mode (SA1). Then, leap second information acquisition unit 460 starts the reception processing of the leap second information (SA2). The reception processing of the leap second information may be performed by the manual operation or may be performed together with the automatic reception processing simultaneously by the time measurement unit 410 described above. The leap second information acquisition unit 460 operates the reception device 30 to perform a search to capture the GPS satellite 100 and the quasi-zenith satellite 101. If at least either of the GPS satellite 100 and the quasi-zenith satellite 101 is captured, the leap second information acquisition unit 460 receives the satellite signal by the reception device 30.

Next, the leap second information acquisition unit 460 determines whether the leap second information can be received from the GPS satellite 100 (SA3).

When it is determined to be No in SA3, the leap second information acquisition unit 460 determines whether or not the first reception time period has run out (SA4). In the present embodiment, the first reception time period is determined to have elapsed (the first reception time period has run out) if 60 or more seconds have elapsed since the reception start (SA2) of the leap second information. That is, the first reception time period is an example of a predetermined time.

If it is determined to be No in SA4, less than 60 seconds have elapsed since the reception start of the leap second information, so that the leap second information acquisition unit 460 returns to SA3 and continues the reception of the leap second information.

If it is determined to be Yes in SA4 and the first reception time period is determined to have run out, the leap second information acquisition unit 460 determines whether or not the reception device 30 is capturing the quasi-zenith satellite 101 (SA5).

Here, that the reception device 30 is in a state of capturing the quasi-zenith satellite 101 when the first reception time period runs out means that the leap second information is not transmitted from the quasi-zenith satellite 101 within the timeout time (the first reception time) of the reception processing while the reception device 30 is capturing the quasi-zenith satellite 101 in the middle of executing the reception processing of the leap second information, which is an example of a case where the leap second information cannot be received.

Also, as an example of the case where the reception device 30 is not capturing the quasi-zenith satellite 101, the case where the leap second information acquisition unit 460 fails to acquire the leap second information due to the low reception strength or the like while the reception device 30 is capturing the GPS satellite 100 only and receiving the first satellite signal 100A transmitted from the GPS satellite 100 and the case where the reception device 30 fails to capture the GPS satellite 100 and the quasi-zenith satellite 101 are presented.

When it is determined to be No in SA5, the leap second information acquisition unit 460 ends the reception processing. That is, when the first reception time period runs out, the leap second information acquisition unit 460 determines to stop the reception processing if the reception device 30 is in a state of not capturing the quasi-zenith satellite 101.

On the other hand, when it is determined to be Yes in SA5, the leap second information acquisition unit 460 continues the reception processing. That is, the when the first reception time period runs out, the leap second information acquisition unit 460 does not stop the reception processing, that is, determines to continue the reception processing, of receiving the second satellite signal 101A if the reception device 30 is in the state of capturing the quasi-zenith satellite 101 that transmits the leap second information every minute, which is the second interval. It should be noted that the reception device 30 may stop, or may continue, the reception processing of receiving the satellite signal transmitted from the position information satellite, when the reception device 30 is capturing another position information satellite such as the GPS satellite 100 or the like.

When it is determined to be Yes in SA5, the leap second information acquisition unit 460 determines whether the leap second information can be received from the quasi-zenith satellite 101 (SA6).

When it is determined to be No in SA6, the leap second information acquisition unit 460 determines whether or not the second reception time period has run out (SA7). In the present embodiment, if 120 or more seconds have elapsed since the reception start of the leap second information (SA2), it is determined that the second reception time period is over (the second reception time period has run out). That is, when the reception device 30 is capturing the quasi-zenith satellite 101, the leap second information acquisition unit 460 extends the reception time period by 60 seconds on the basis of the second satellite signal 101A receivable from the quasi-zenith satellite 101 being captured by the reception device 30.

Since less than 120 seconds have elapsed since the leap second information reception start, the leap second information acquisition unit 460 returns to SA6 and continues the reception of the leap second information if it is determined to be No in SA7.

If it is determined to be Yes in SA7 and it is determined that the second reception time period has run out, the leap second information acquisition unit 460 ends the reception processing.

In this way, in the present embodiment, when the first reception time period has run out, the leap second information acquisition unit 460 of the control device 40 determines whether or not to stop the reception processing on the basis of the type of satellite signal receivable from the position information satellite captured by the reception device 30.

When it is determined to be Yes in SA3 and SA6, the leap second correction unit 470 stores the leap second information acquired by the leap second information acquisition unit 460 in the leap second update data 620 of the storage device 60. Then, the leap second correction unit 470 corrects the internal time data 630 using the current leap second of the leap second update data 620 (SA8). If the internal time data 630 is corrected, the clock display time data 640 is also corrected by the set time zone data 650. After the processing of SA8 is performed, the display control unit 480 displays the current time on the display device 90 (SA9). That is, the display control unit 480 displays the time indicated by the clock display time data 640 on the display device 90.

In this way, the corrected time is displayed on the display device 90 on the basis of the received leap second information after the processing of SA8 is performed.

Operation Effect of First Embodiment

According to the present embodiment, the following effect can be obtained.

In the present embodiment, when the first reception time period has run out, the leap second information acquisition unit 460 extends the timeout time of the reception processing to 120 seconds which is the second reception time period if the reception device 30 is in the state of capturing the quasi-zenith satellite 101. In this case, since the leap second information is transmitted from the quasi-zenith satellite 101 every minute which is the second interval, the possibility that the leap second information can be acquired in a short time period becomes high by the timeout time of the reception processing being extended. If the reception processing is stopped, it is necessary to start from the search for the GPS satellite 100 and quasi-zenith satellite 101 when the reception processing is executed again, so that the power consumption increases. Therefore, according to the present embodiment, the reception success rate can be improved while the power consumption is suppressed.

Second Embodiment

Next, a second embodiment will be described on the basis of the drawings.

It should be noted that since the structure of the electronic timepiece 1 in accordance with the present embodiment is the same as in the first embodiment, detailed description thereof is skipped or simplified.

Figure 9:
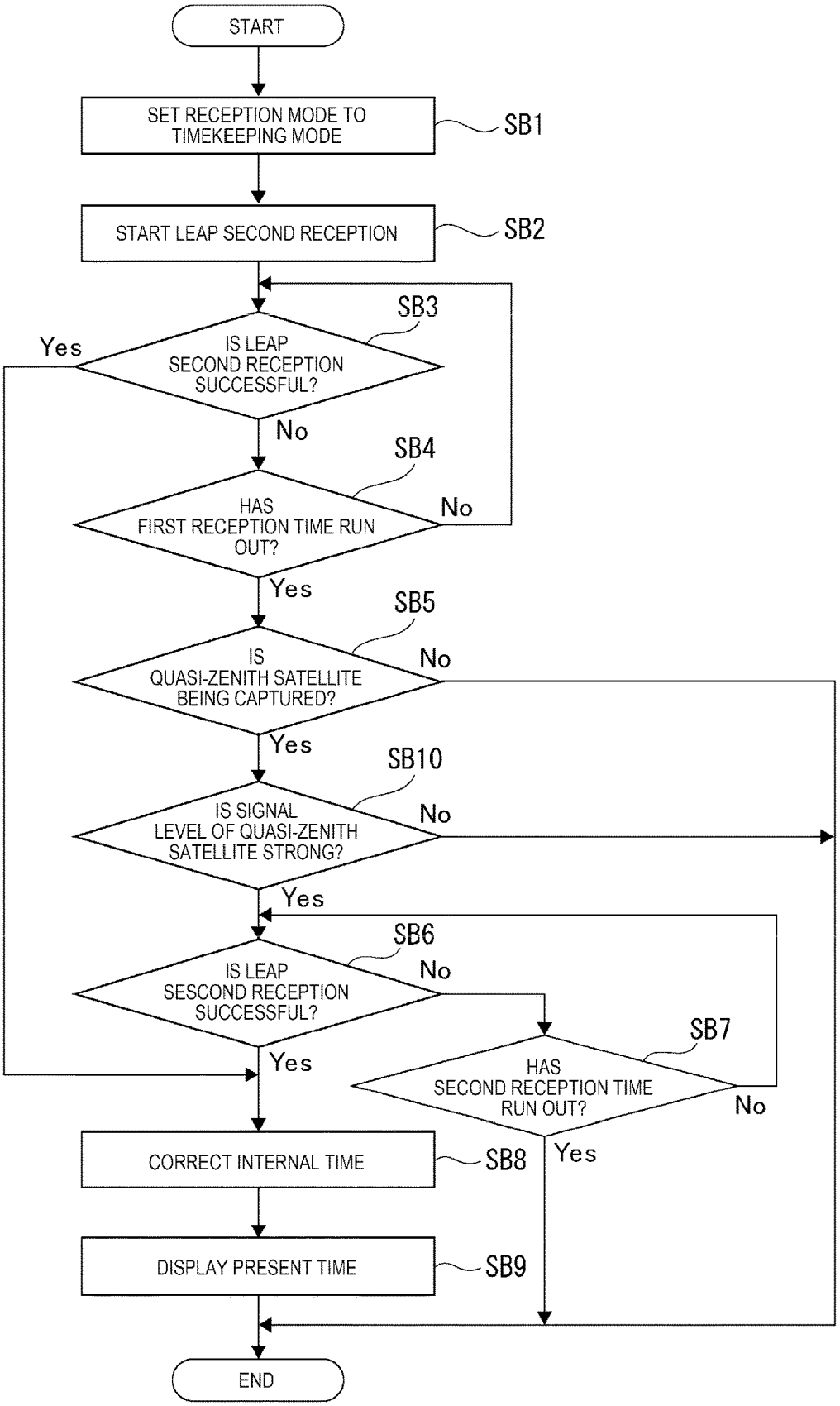
FIG. 9 is a flowchart showing the reception processing of the leap second information in accordance with a second embodiment.

FIG. 9 is a flowchart showing the reception processing of the leap second information of the electronic timepiece 1 in accordance with the second embodiment.

The present embodiment is different from the first embodiment in that the leap second information acquisition unit 460 determines the signal level of the second satellite signal 101A transmitted from the quasi-zenith satellite 101 when the first reception time period runs out. It should be noted that the processing of SB1 to SB9 is the same as the processing of SA1 to SA9 in the first embodiment.

In the present embodiment, when the first reception time period runs out, the leap second information acquisition unit 460 determines whether or not the signal level of the second satellite signal 101A that the reception device 30 is receiving is strong, that is, whether or not the reception strength of the second satellite signal 101A is equal to or greater than a predetermined value (SB10) when the reception device 30 is determined to be capturing the quasi-zenith satellite 101 (SB5: Yes).

Here, the value of about "30" in SNR (signal to noise ratio) is presented as an example of the predetermined value for determining the reception strength. The leap second information can be accurately acquired if the value of about "30" in SNR is set.

When it is determined to be Yes in SB10, the leap second information acquisition unit 460 continues the reception processing. That is, when it is determined to be yes in SB10, the reception strength of the second satellite signal 101A is equal to or greater than the predetermined value and the leap second information can be accurately acquired, so that the leap second information acquisition unit 460 continues the reception processing, that is, determines not to stop the reception processing.

On the other hand, when it is determined to be No in SB10, the leap second information acquisition unit 460 ends the reception processing. That is, when the reception strength of the second satellite signal 101A is less than the predetermined value, the possibility that the leap second information cannot be accurately acquired even if the quasi-zenith satellite 101 is being captured, so that the leap second information acquisition unit 460 determines to stop the reception processing.

Operation Effect of the Second Embodiment

According to the present embodiment, the following effect can be obtained.

In the present embodiment, the leap second information acquisition unit 460 of the control device 40 varies the timeout time of the reception processing in accordance with the reception strength of the second satellite signal 101A. Therefore, when the reception strength of the second satellite signal 101A is equal to or greater than the predetermined value and the possibility that the leap second information can be accurately acquired is high, the leap second information acquisition unit 460 extends the timeout time of the reception processing to the second reception time. In this way, the reception success rate can be improved. Also, when the reception strength of the second satellite signal 101A is low, the leap second information acquisition unit 460 determines to stop the reception processing since there is a possibility that the leap second information cannot be accurately acquired even if the reception device 30 is capturing the quasi-zenith satellite 101. In this way, wasteful reception processing can be avoided and the power consumption can be suppressed.

Third Embodiment

Next, a third embodiment of the invention will be described on the basis of the drawings.

It should be noted that since the structure of the electronic timepiece 1 in accordance with the present embodiment is the same as in the first and the second embodiments, the detailed description thereof will be skipped or simplified.

Figure 10:
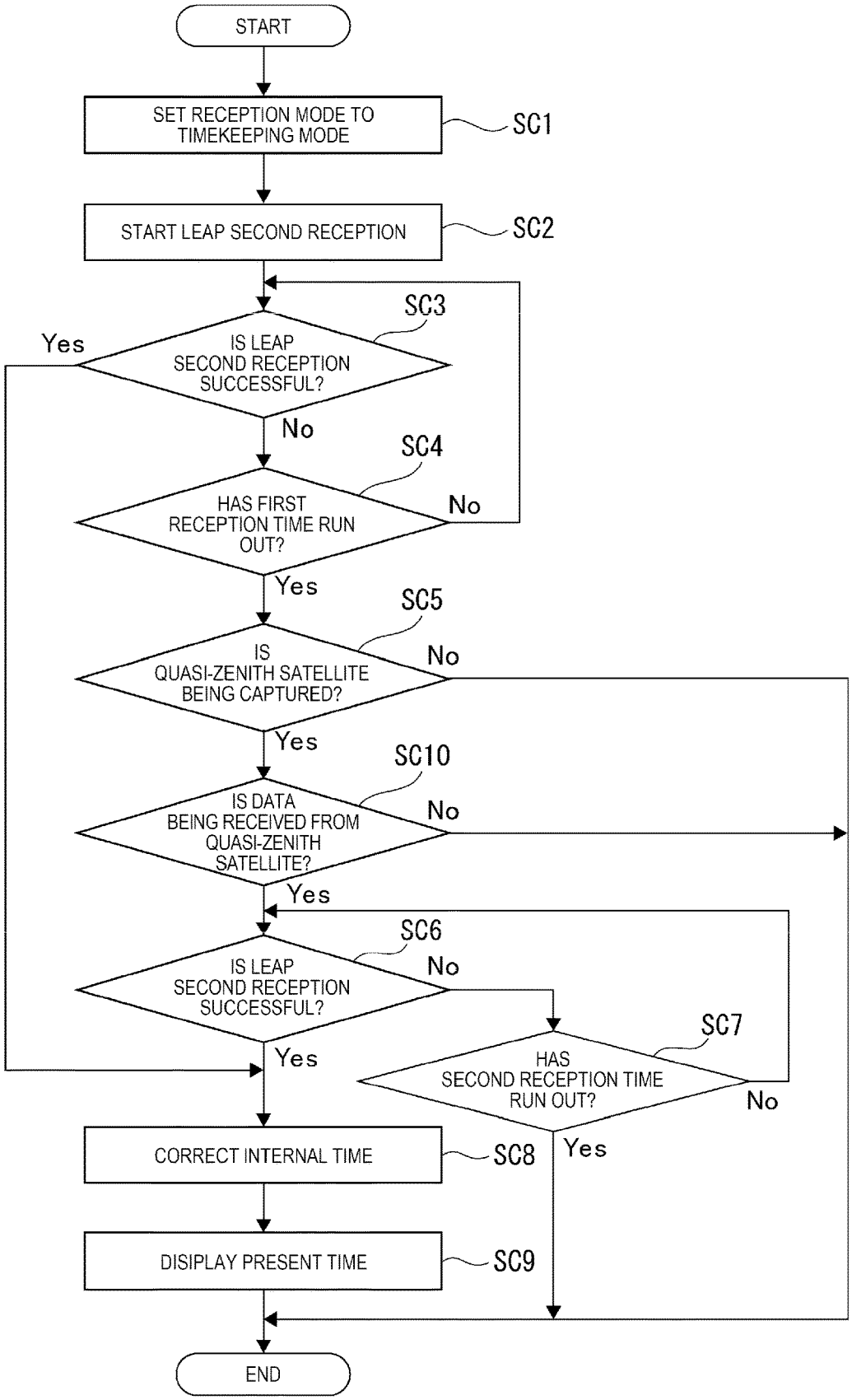
FIG. 10 is a flowchart showing the reception processing of the leap second information in accordance with a third embodiment.

FIG. 10 is a flowchart showing the reception processing of the leap second information of the electronic timepiece 1 in accordance with the third embodiment.

The present embodiment is different from the first embodiment in that the leap second information acquisition unit 460 determines whether or not to receive the second satellite signal 101A transmitted from the quasi-zenith satellite 101 when the first reception time period has run out. The processing of SC1 to SC9 is the same as the processing of SA1 to SA9 in the first embodiment.

In the present embodiment, when it is determined that the first reception time period has run out and that the reception device 30 is capturing the quasi-zenith satellite 101 (SC5: Yes), the leap second information acquisition unit 460 determines whether or not the reception device 30 is receiving the second satellite signal 101A (SC10).

Here, the state in which the reception device 30 is receiving the second satellite signal 101A when the first reception time period has run out means the state in which the reception device 30 is receiving the navigation message, that is, the state in which the navigation message is demodulated by the BB unit described above and the navigation message is being acquired.

When it is determined to be Yes in SC10, the leap second information acquisition unit 460 continues the reception processing. That is, since the reception device 30 is in a state of receiving the second satellite signal 101A when it is determined to be Yes in SC10, the possibility that the leap second information can be acquired is high if the timeout time of the reception processing is extended to the second reception time period. Therefore, the leap second information acquisition unit 460 continues the reception processing, that is, determines not to stop the reception processing.

On the other hand, when it is determined to be No in SC10, the leap second information acquisition unit 460 ends the reception processing. That is, when it is determined to be No in SC10, the leap second information acquisition unit 460 determines to stop the reception processing since the possibility that the leap second information can be acquired is low even if the reception device 30 is capturing the quasi-zenith satellite 101.

Operation Effect of Third Embodiment

According to the present embodiment, the following effect can be obtained.

In the present embodiment, the leap second information acquisition unit 460 of the control device 40 determines whether or not the second satellite signal 101A is being received and varies the timeout time of the reception processing. Therefore, the leap second information acquisition unit 460 can improve the reception success rate by extending the timeout time of the reception processing when the second satellite signal 101A is received, and can suppress the power consumption by ending the reception processing when the second satellite signal 101A is not being received.

Fourth Embodiment

Next, the fourth embodiment according to the invention will be described on the basis of the drawings.

It should be noted that, since the structure of the electronic timepiece 1 according to the present embodiment is the same as in the first to third embodiments, detailed description thereof will be skipped or simplified.

Figure 11:
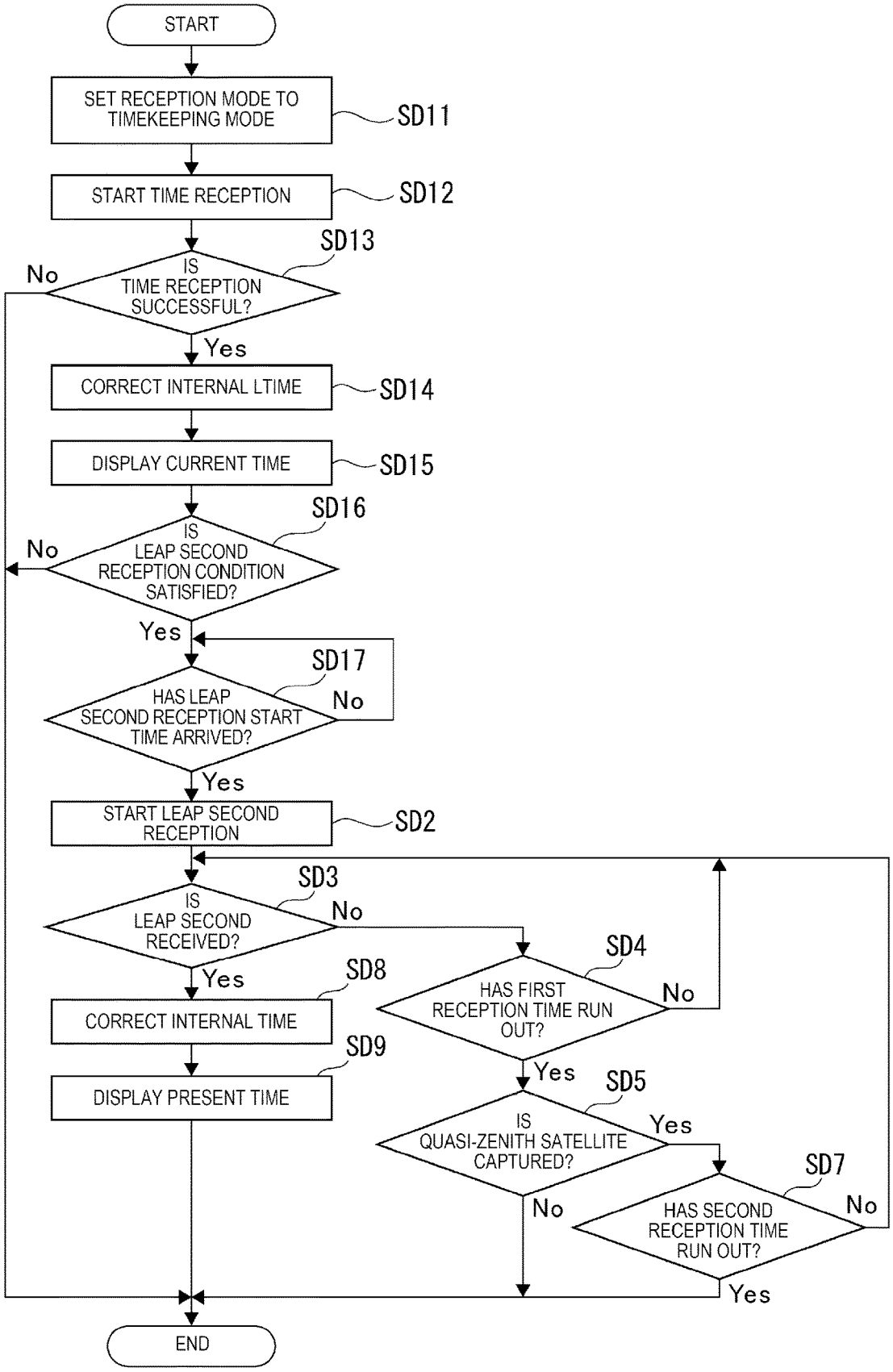
FIG. 11 is a flowchart showing the reception processing of time information in accordance with a fourth embodiment.

FIG. 11 is a flowchart showing the reception processing of the time information of the electronic timepiece 1 in accordance with the fourth embodiment.

The present embodiment is different from the first embodiment in that, first, the time information is acquired from the GPS satellite 100 so that the internal time information is corrected and that the reception processing of the leap second information is executed at the time when the leap second information is transmitted from the GPS satellite 100 on the basis of the corrected internal time information. It should be noted that the processing of SD2 to SD5 and SD7 to SD9 is the same as the processing of SA2 to SA5 and SA7 to SA9 in the first embodiment.

In the present embodiment, when the condition to execute the automatic reception processing is satisfied, or when the reception operation of pushing the button 7A for three seconds or longer and for less than six seconds, the time measurement unit 410 sets the reception mode to the time measurement mode (SD11) and starts the reception processing (SD12). As described above, the time measurement unit 410 determines that the condition to start the automatic reception is satisfied when the fixed-time reception time period has arrived, or when the voltage or the current generated by the solar panel 25 reaches or exceeds the set value.

That is, the time measurement unit 410 operates the reception device 30 so as to perform the search for capturing the GPS satellite 100 and captures at least one GPS satellite 100. Then, if the time measurement unit 410 captures the GPS satellite 100, the time measurement unit 410 starts reception of the first satellite signal 100A by the reception device 30 and acquires the time information.

Next, the time measurement unit 410 determines whether the reception of the time information is successful (SD13). That is, when the time information is acquired, the time measurement unit 410 determines that the reception is successful when the measurement unit 410 determines the acquired time information to be correct by comparing the acquired time information with the internal time.

The time measurement unit 410 ends the reception processing when it is determined to be No in SD13.

When it is determined to be Yes in SD13, the time correction unit 450 corrects the internal time (SD14). That is, the time correction unit 450 corrects the received time data 610 and the internal time data 630 by the time information acquired by the time measurement unit 410. When the current leap second is stored in the leap second update data 620 at this time, the leap second correction unit 470 corrects the internal time data 630 by the stored current leap second. If the internal time data 630 is corrected, the clock display time data 640 is also corrected by the set time zone data 650.

Next, the display control unit 480 displays the current time on the display device 90 (SD15). That is, the display control unit 480 displays the time indicated by the clock display time data 640 on the display device 90. Specifically, the display control unit 480 controls the drive mechanism 22 and moves the hand 3 (second hand 3B, minute hand 3C, and hour hand 3D) so as to display the time.

In this way, the time corrected on the basis of the received time information is displayed on the display device 90.

Next, the control device 40 determines whether the leap second reception condition is satisfied (SD16). That is, when the leap second information is not stored in the leap second update data 620 and when the calendar date falls on June 1 to 30 or December 1 to 31 according to the internal time information stored in the internal time data 630 and the reception of the leap second information is not successful during the period, the control device 40 determines Yes in SD16.

When it is determined to be No in SD16, the control device 40 ends the reception processing.

When it is determined to be Yes in SD16, the leap second information acquisition unit 460 determines whether the time has come when the leap second information is transmitted from the GPS satellite 100 (SD17). The leap second information acquisition unit 460 can determine the reception start time of the leap second information transmitted from the GPS satellite 100 on the basis of the internal time data 630 kept by the timekeeping device 50.

If it is determined to be No in SD17, the leap second information acquisition unit 460 stands by until the leap second information reception start time.

On the other hand, if it is determined to be Yes in SD17, the processing of SD2 to SD7 is executed and internal time is corrected (SD8) when the leap second information can be acquired. That is, in the present embodiment, the reception device 30 executes the reception processing in time with the timing of the GPS satellite 100 transmitting the leap second information.

The display control unit 480 displays the current time on the display device 90 (SD9) after the processing of SD8 is executed. That is, the display control unit 480 displays the time indicated by the clock display time data 640 on the display device 90.

In this way, the time corrected on the basis of the received time information and the leap second information is displayed on the display device 90 after the processing of SD8 is executed.

Operation Effect of Fourth Embodiment

According to the present embodiment, the following effect can be obtained.

In the embodiment, the time correction unit 450 corrects the internal time data 630 on the basis of the time information acquired by the time measurement unit 410. Then, the reception device 30 determines the timing of the GPS satellite 100 transmitting the leap second information and executes the reception processing on the basis of the corrected internal time data 630. Therefore, the execution of reception processing can be prevented while the GPS satellite 100 does not transmit the leap second information, so that the reception success rate can be improved and the power consumption can be suppressed.

Fifth Embodiment

Next, a fifth embodiment will be described on the basis of drawings.

It should be noted that since the structure of the electronic timepiece 1 of the embodiment is the same as that of the first to fourth embodiment, the detailed description thereof will be omitted or simplified.

Figure 12:
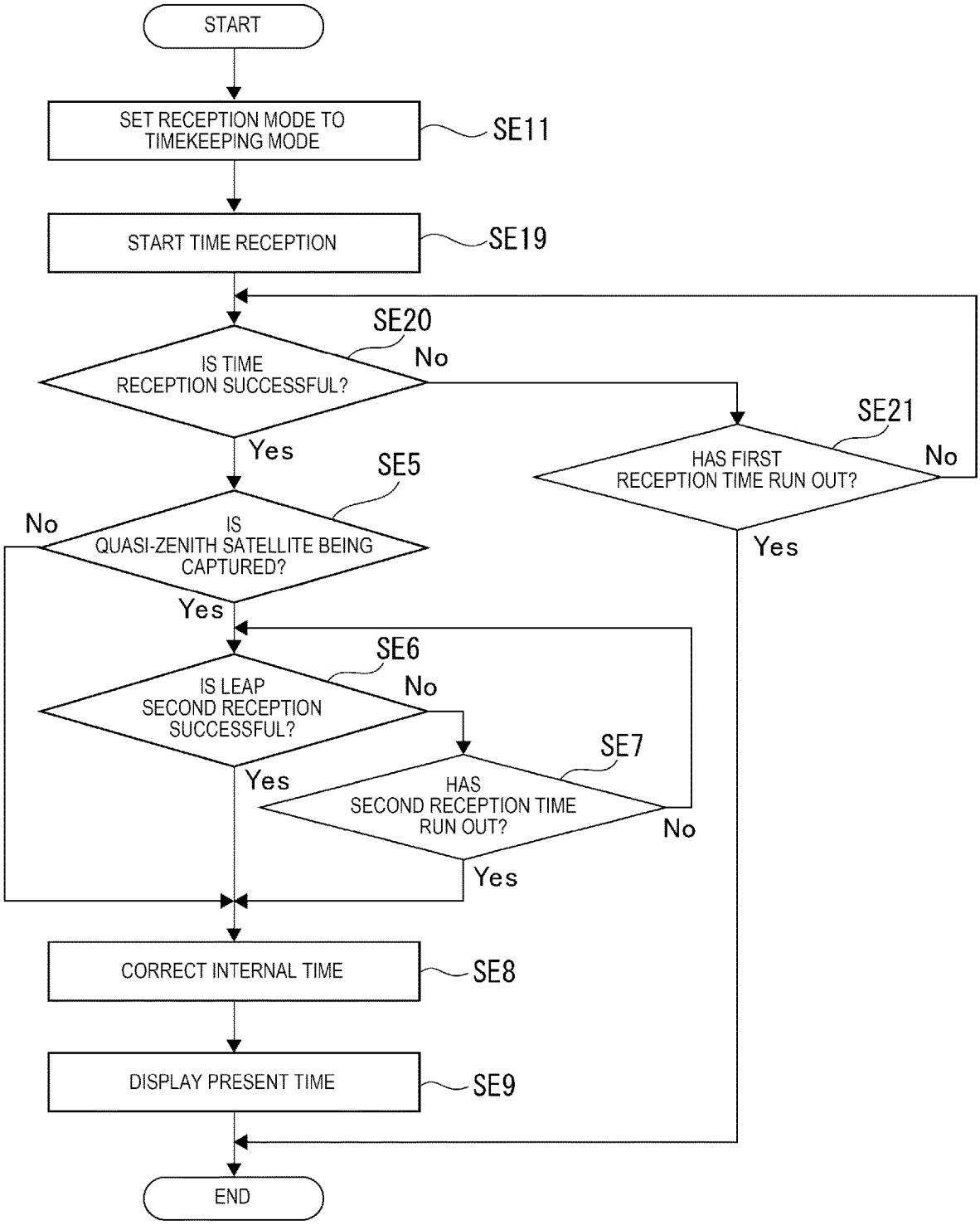
FIG. 12 is a flowchart showing the reception processing of the time information in accordance with a fifth embodiment.

FIG. 12 is a flowchart showing the reception processing of time information of the electronic timepiece 1 in accordance with the fifth embodiment.

The present embodiment is different from the fourth embodiment in that, when the time information and leap second information are received concurrently and the reception of time information is successful, the reception of the leap second information is not put on hold until the leap second information is transmitted from the GPS satellite 100 if the reception device 30 is capturing the quasi-zenith satellite 101. It should be noted that the processing of SE5, SE7 to SE9, and SE11 is the same as the processing of SD5, SD7 to SD9, and SD11 in the fourth embodiment.

In the present embodiment, the time measurement unit 410 causes the reception processing of the time information to be executed and the leap second information acquisition unit 460 causes the reception processing of the leap second information to be executed (SE19).

Next, the time measurement unit 410 determines whether the reception of the time information was successful (SE20).

When it is determined to be No in SE20, the time measurement unit 410 determines whether or not the first reception has timed out (SE21). In the present embodiment, if 60 or more seconds have elapsed since the reception start (SA19) of the time information and the leap second information, it is determined that the first reception time period has passed (the first reception has timed out).

If it is determined to be No in SE21 because less than 60 seconds have passed since the reception start of the time information and the leap second information, the time measurement unit 410 and the leap second information acquisition unit 460 return to SE20 and continue the reception of the time information and leap second information.

When it is determined to be Yes in SE21, the time measurement unit 410 ends the reception processing.

When it is determined to be Yes in SE20, the leap second information acquisition unit 460 determines whether or not the reception device 30 is capturing the quasi-zenith satellite 101 (SE5).

When it is determined to be No in SE5, the leap second correction unit 470 updates the leap second information stored in the leap second update data 620 when the leap second information can be acquired while the time information is received in SE20. Then, the time correction unit 450 corrects the internal time data 630 on the basis of the acquired time information and the leap second information (SE8). Also, when the leap second information cannot be acquired in SE20, the time correction unit 450 corrects the internal time data 630 on the basis of the acquired time information (SE8). At this time, like SD16 in the fourth embodiment, the time correction unit 450 may stand by until the leap second information reception condition is satisfied.

When it is determined to be Yes in SE5, the leap second correction unit 470 corrects the internal time data 630 (SE8) using the present leap second of the leap second update data 620 when the processing of SE6 and SE7 is executed and the leap second information can be acquired (SE6: YES). Also, when it is determined to be Yes in SE7, the time correction unit 450 corrects the internal time data 630 on the basis of the acquired time information (SE8).

Operational Effect of Fifth Embodiment

According to the present embodiment, the following effects can be obtained.

In the present embodiment, the leap second information acquisition unit 460 starts the reception processing of the leap second information simultaneously with the reception processing of the time information. Then, when the reception of the time information is successful, the reception processing is continued without standing by until the leap second information is transmitted from the GPS satellite 100 if the reception device 30 is capturing the quasi-zenith satellite 101. Therefore it is possible to acquire the time information and the leap second information in a short time period. Therefore, the power consumption can be suppressed while user convenience can be improved.

Other Embodiments

The invention is not limited to the configuration of each embodiment, and various modifications can be implemented within the scope of the invention.

In each of the embodiments, the GPS satellite 100 is presented as an example of the first position information satellite and the quasi-zenith satellite 101 is presented as an example of the second position information satellite, but the invention is not limited thereto. For example, other global navigation satellite system (GNSS) such as Galileo (EU), GLONASS (Russia), and Beidou (China) can be applied as the position information satellite. Also, different types of satellite signal may be received from each of a plurality of GPS satellites. Since the position information satellites such as GPS satellites usually transmit a plurality of types of satellite signal, the invention also includes a case where the first satellite signal is received from one GPS satellite and the second satellite signal which is of a type different from the first satellite signal is received from the other GPS satellite and the determination as to whether or not to stop the reception processing depends on the type. Further, the invention also includes a case where different types of satellite signal are received as the first satellite signal and the second satellite signal from the same GPS satellite and the quasi-zenith satellite and the determination as to whether or not to stop the reception processing depends on the types.

In the embodiments described above, the electronic timepiece 1 may have the time measurement mode and the positioning mode, and may also have a leap second reception mode in addition to the modes.

The leap second reception mode is a mode in which the electronic timepiece 1 captures one or more position information satellites among the position information satellites such as the GPS satellite or the quasi-zenith satellite transmitting the leap second information so as to receive the satellite signal and acquires the leap second information transmitted at the predetermined intervals (12.5 minutes in case of GPS satellite signal). In the leap second reception mode, the time information is also acquired from the satellite signal at the same time.

The leap second reception mode is set by the operation of the button 7B like the time measurement mode and the positioning mode. When the reception mode is set to the leap second reception mode, the second hand 3B may be moved to "Leap (lead second)" position (55 second position) and the remaining time until the leap second information reception start time may be displayed on the display device 90 in a countdown form with the intervals of a minute. Thus, the user can know that the reception of the leap second information is to start soon and the reception success rate of the leap second information can be improved if the electronic timepiece 1 is moved to a location where the satellite signal is better received.

Also, when the acquisition of the location information in the position mode can confirm that the electronic timepiece 1 is positioned outside the range where the reception of the quasi-zenith satellite 101 is possible, the possibility that the quasi-zenith satellite 101 cannot be captured is high, and, therefore, when the first reception time period has elapsed, the reception processing may be stopped without determining whether or not to stop the reception processing. Also, when the electronic timepiece 1 is positioned outside the range where the reception of the quasi-zenith satellite 101 is possible, the quasi-zenith satellite 101 may not be captured. That is, the search of the quasi-zenith satellite 101 may not be performed.

The electronic timepiece according to the invention is not limited to the provision of a reception device 30 that receives the satellite signal of the GPS satellite 100 but can also be applied to an electronic timepiece having a device with large power consumption such as equipment for wireless communication with other electronic equipment.

Also, the electronic timepiece is not limited to a wristwatch but can be used widely in an apparatus having a device with large power consumption and having a timepiece mechanism that is carried for use, such as a mobile phone and a portable GPS receiver used for mountain climbing.

The entire disclosure of Japanese Patent Application No. 2018-052256, filed Mar. 20, 2018 is expressly incorporated by reference herein.

What is claimed is:

1. An electronic timepiece comprising:

a receiver that executes a reception process to capture a position information satellite transmitting leap second information and receive a satellite signal transmitted from the captured position information satellite; and a controller that acquires the leap second information on the basis of the satellite signal received by the receiver, wherein the controller determines whether or not to stop the reception process on the basis of a type of satellite signal receivable from the position information satellite captured by the receiver, the receiver executes the reception process to capture a first position information satellite that transmits the leap second information at a first interval, capture a second position information satellite that transmits the leap second information at a second interval shorter than the first interval, and receive a first satellite signal transmitted from the captured first position information satellite and a second satellite signal transmitted from the captured second position information satellite, and when the leap second information cannot be acquired in a predetermined time period since the start of the reception process, the controller determines to continue the reception process to receive the second satellite signal if the receiver is in a state of capturing the second position information satellite, and determines to stop the reception process if the receiver is in a state of not capturing the second position information satellite.

2. The electronic timepiece according to claim 1, wherein the first position information satellite is a GPS satellite and the second position information satellite is a quasi-zenith satellite.

3. The electronic timepiece according to claim 1, wherein the receiver starts the reception process in time with the timing of the position information satellite transmitting the leap second information.

4. The electronic timepiece according to claim 3, further comprising:

a timekeeper that keeps internal time information, wherein the receiver executes a time information reception process that captures the position information satellite transmitting a time information and receives the satellite signal transmitted from the captured position information satellite, the controller executes a time measurement process that acquires the time information on the basis of the satellite signal received by the receiver and a time correction process that corrects the internal time information on the basis of the time information acquired by the time measurement process, and the receiver determines the timing of the position information satellite transmitting the leap second information on the basis of the internal time information corrected by the time correction process and starts the reception process in time with the determination timing.

5. An electronic timepiece comprising:

a receiver that executes a reception process to capture a position information satellite transmitting leap second information and receive a satellite signal transmitted from the captured position information satellite; and a controller that acquires the leap second information on the basis of the satellite signal received by the receiver, wherein the controller determines whether or not to stop the reception process on the basis of a type of satellite signal receivable from the position information satellite captured by the receiver, the receiver executes the reception process to capture a first position information satellite that transmits the leap second information at a first interval, capture a second position information satellite that transmits the leap second information at a second interval shorter than the first interval, and receive a first satellite signal transmitted from the captured first position information satellite and a second satellite signal transmitted from the captured second position information satellite, and when the leap second information cannot be acquired in a predetermined time period since the start of the reception process, the controller determines to continue the reception process to receive the second satellite signal if the receiver is in a state of capturing the second position information satellite and reception strength of the second satellite signal is equal to or greater than a predetermined value, determines to stop the reception process if the receiver is in a state of capturing the second position information satellite and the reception strength is less than the predetermined value, and determines to stop the reception process if the receiver is in a state of not capturing the second position information satellite.

6. The electronic timepiece according to claim 5, wherein the first position information satellite is a GPS satellite and the second position information satellite is a quasi-zenith satellite.

7. The electronic timepiece according to claim 5, wherein the receiver starts the reception process in time with the timing of the position information satellite transmitting the leap second information.

8. The electronic timepiece according to claim 7, further comprising:

a timekeeper that keeps internal time information, wherein the receiver executes a time information reception process that captures the position information satellite transmitting a time information and receives the satellite signal transmitted from the captured position information satellite, the controller executes a time measurement process that acquires the time information on the basis of the satellite signal received by the receiver and a time correction process that corrects the internal time information on the basis of the time information acquired by the time measurement process, and the receiver determines the timing of the position information satellite transmitting the leap second information on the basis of the internal time information corrected by the time correction process and starts the reception process in time with the determination timing.

9. An electronic timepiece comprising:

a receiver that executes a reception process to capture a position information satellite transmitting leap second information and receive a satellite signal transmitted from the captured position information satellite; and a controller that acquires the leap second information on the basis of the satellite signal received by the receiver, wherein the controller determines whether or not to stop the reception process on the basis of a type of satellite signal receivable from the position information satellite captured by the receiver, the receiver executes the reception process to capture a first position information satellite that transmits the leap second information at a first interval, capture a second position information satellite that transmits the leap second information at a second interval shorter than the first interval, and receive a first satellite signal transmitted from the captured first position information satellite and a second satellite signal transmitted from the captured second position information satellite, and when the leap second information cannot be acquired in a predetermined time period since the start of the reception process, the controller determines to continue the reception process of receiving the second satellite signal if the receiver is in a state of capturing the second position information satellite and is receiving the second satellite signal, determines to stop the reception process if the receiver is in a state of capturing the second position information satellite and is not receiving the second satellite signal, and determines to stop the reception process if the receiver is in a state of not capturing the second position information satellite.

10. The electronic timepiece according to claim 9, wherein the first position information satellite is a GPS satellite and the second position information satellite is a quasi-zenith satellite.

11. The electronic timepiece according to claim 9, wherein the receiver starts the reception process in time with the timing of the position information satellite transmitting the leap second information.

12. The electronic timepiece according to claim 11, further comprising:

a timekeeper that keeps internal time information, wherein the receiver executes a time information reception process that captures the position information satellite transmitting a time information and receives the satellite signal transmitted from the captured position information satellite, the controller executes a time measurement process that acquires the time information on the basis of the satellite signal received by the receiver and a time correction process that corrects the internal time information on the basis of the time information acquired by the time measurement process, and the receiver determines the timing of the position information satellite transmitting the leap second information on the basis of the internal time information corrected by the time correction process and starts the reception process in time with the determination timing.

* * * * *